US009810484B2

(12) United States Patent
Gruber et al.

(10) Patent No.: US 9,810,484 B2
(45) Date of Patent: Nov. 7, 2017

(54) HEAT EXCHANGER WITH HEADER CONTACT REGIONS FOR TUBES SUPPORT

(71) Applicant: BEHR GMBH & CO. KG, Stuttgart (DE)

(72) Inventors: Timo Gruber, Ludwigsburg (DE); Werner Helms, Esslingen (DE); Chi-Duc Nguyen, Stuttgart (DE); Hicham Rouhana, Korntal-Münchingen (DE); Peter Wolfangel, Renningen (DE)

(73) Assignee: MAHLE INTERNATIONAL GMBH, Stuttgart (DE)

( * ) Notice: Subject to any disclaimer, the term of this patent is extended or adjusted under 35 U.S.C. 154(b) by 458 days.

(21) Appl. No.: 14/354,895

(22) PCT Filed: Oct. 26, 2012

(86) PCT No.: PCT/EP2012/071322
§ 371 (c)(1),
(2) Date: Apr. 28, 2014

(87) PCT Pub. No.: WO2013/060882
PCT Pub. Date: May 2, 2013

(65) Prior Publication Data

US 2014/0262187 A1 Sep. 18, 2014

(30) Foreign Application Priority Data

Oct. 28, 2011 (DE) ..... 10 2011 085 479

(51) Int. Cl.
*F28F 9/02* (2006.01)
*F28F 1/10* (2006.01)
(Continued)

(52) U.S. Cl.
CPC ..... *F28F 1/10* (2013.01); *B21D 53/08* (2013.01); *F28D 1/05358* (2013.01);
(Continued)

(58) Field of Classification Search
CPC ..... F28F 1/10; F28F 1/126; F28F 2225/04; F28F 9/0224; F28F 9/0226; F28F 9/0221;
(Continued)

(56) References Cited

U.S. PATENT DOCUMENTS

RE31,889 E * 5/1985 Nonnenmann ..... F28F 9/0226 165/173
4,546,822 A * 10/1985 Tamura ..... F28F 9/0226 165/149
(Continued)

FOREIGN PATENT DOCUMENTS

CN 1095022 A 11/1994
CN 1965209 A 5/2007
(Continued)

OTHER PUBLICATIONS

International Search Report, PCT/EP2012/071322, dated Mar. 7, 2013, 2 pgs.
(Continued)

*Primary Examiner* — Etsub Berhanu
*Assistant Examiner* — Jose O Class-Quinones
(74) *Attorney, Agent, or Firm* — Paul D. Strain, Esq.; Strain & Strain PLLC

(57) ABSTRACT

The application relates to a heat exchanger having a block with ribs and rectangular tubes. The block is arranged between a first collecting box and a second collecting box. Each collecting box is closed off by a base which has eyelets for receiving the tubes, and a trough-shaped circulating section for receiving the collecting box extends along the edge of the base. The base has an elevated contact region on
(Continued)

at least one end face for the tube which lies directly opposite the end face in order to allow a stable structure of the heat exchanger, collecting boxes, and block.

8 Claims, 4 Drawing Sheets

(51) Int. Cl.
*B21D 53/08* (2006.01)
*F28D 1/053* (2006.01)
*F28F 1/12* (2006.01)

(52) U.S. Cl.
CPC ..... *F28D 1/05366* (2013.01); *F28D 1/05383* (2013.01); *F28F 9/0221* (2013.01); *F28F 9/0224* (2013.01); *F28F 9/0226* (2013.01); *F28F 1/126* (2013.01); *F28F 2225/04* (2013.01)

(58) Field of Classification Search
CPC .... F28F 9/02; F28F 9/0219; F28F 9/04; F28F 9/12; F28D 1/05383; F28D 1/05358; F28D 1/05366; B21D 53/08
USPC ..... 165/173; 29/890.052, 890.04
See application file for complete search history.

(56) References Cited

U.S. PATENT DOCUMENTS 5,664,625 A * 9/1997 Letrange ..... F28F 9/02 165/149
6,988,544 B2 * 1/2006 Ozaki ..... F28F 9/182 165/152
2006/0144579 A1 * 7/2006 Ozaki ..... F28D 1/05366 165/173
2006/0151158 A1 * 7/2006 Ozaki ..... F28D 1/05366 165/173
2006/0185833 A1 8/2006 Brost et al.
2010/0051252 A1 * 3/2010 Ninagawa ..... F28F 1/022 165/175

FOREIGN PATENT DOCUMENTS

| | | | |
|---|---|---|---|
| CN | 101097122 | A | 1/2008 |
| CN | 101103244 | A | 1/2008 |
| CN | 101111736 | A | 1/2008 |
| DE | 10 2006 005 421 | A1 | 8/2006 |
| DE | 10 2005 054 043 | A1 | 5/2007 |
| DE | 10 2007 033 976 | A1 | 1/2009 |
| DE | 10 2007 052 888 | A1 | 5/2009 |
| DE | 10 2009 035 089 | A1 | 2/2011 |
| EP | 0 791 797 | A1 | 8/1997 |
| EP | 0791791 | A1 | 8/1997 |
| EP | 1 972 879 | A2 | 9/2008 |
| EP | 1 995 544 | A2 | 11/2008 |

OTHER PUBLICATIONS

German Search Report, DE 10 2011 085 479.7, dated Feb. 6, 2012, 8 pgs.

* cited by examiner

HEAT EXCHANGER WITH HEADER CONTACT REGIONS FOR TUBES SUPPORT

CROSS-REFERENCE TO RELATED PATENT APPLICATIONS

This application is a National Stage of International Application No. PCT/EP2012/071322, filed Oct. 26, 2012, which is based upon and claims the benefit of priority from prior German Patent Application No. 10 2011 085 479.7, filed Oct. 28, 2011, the entire contents of all of which are incorporated herein by reference in their entirety.

TECHNICAL FIELD

The invention relates to a heat exchanger, comprising a block which has fins and tubes and is arranged between a first collecting tank for introducing the medium to be cooled, and a second collecting tank for discharging said medium, wherein each collecting tank is closed off by a base which has rim holes for receiving the tubes, and a channel-shaped circulating means for receiving the collecting tank extends along the edge of the base.

PRIOR ART

Customary heat exchangers consist of an inlet collecting tank and an outlet collecting tank, wherein a block in which tubes which connect the two collecting tanks to each other are located is arranged between the two collecting tanks. The heat exchanger is arranged in front of the internal combustion engine. A cooling medium which is heated by a heat output by the internal combustion engine flows through the two collecting tanks and the tubes. An air flow which absorbs the heat output by the cooling medium and removes said heat from the region of the heat exchanger passes through the fins formed between the tubes. The cooling medium cooled in this manner is supplied again to the internal combustion engine.

DE 10 2009 035 089 A1 discloses a heat exchanger of the type in question. Each collecting tank is closed here by a base. The base comprises a plurality of openings, wherein a tube which preferably has a rectangular cross section is pushed into each opening. The end side of the opening receiving the tube has an arched portion in the form of a clamping lug that serves frictionally to hold the tube pushed into the opening prior to the soldering.

DE 10 2006 005 421 A1 describes a heat exchanger in which the end side of the base has cams directed toward the collecting tank. The collecting tank is clamped between the cams and the base edge, and therefore further fastening devices, such as a bead encircling the base edge, can be dispensed with.

Failures occur at the outer tubes, which are in particular opposite the end sides of the base, in particular due to a frequent change in the internal pressure of the coolant flowing in the tubes. For construction space reasons, the cooling fins which customarily stabilize and support said tubes are not usable in said outer tubes. In particular in the event of use of tubes of folded design, which have a small wall thickness, the heat exchanger has an unstable contour. The absence of the fins at the two tubes opposite the end sides of the base may result in a permanent breakage in the folding region of the tubes because of the change in pressure due to a stress concentration occurring, and this results in a failure of the heat exchanger.

SUMMARY OF THE INVENTION, OBJECT, SOLUTION, ADVANTAGES

The invention is therefore based on the object of specifying a heat exchanger, in which the tubes directly opposite the end sides of the base have high strength despite fins being absent.

According to the invention, the object is achieved in that the base has a raised contact region on at least one end side for the tube directly opposite the end side. Said contact region takes on the supporting of the tube, as a result of which the strength of the heat exchanger to cope with a change in pressure is increased. Such a contact region can be produced in a simple manner here by maintaining the cross section of the rim hole in the base.

The contact region is advantageously designed rising from the channel-shaped circulating means to a rim hole receiving the tube, wherein the contact region preferably spans an expanded region between the rear side of the channel-shaped circulating means and the rim hole. The contact region extending in this manner neutralizes the critical region and leads to a stabilization of the tube which runs directly parallel to the end side. The contact region here takes on the supporting function and prevents weakening of the heat exchanger.

In one refinement, the contact region is locally delimited. By means of the local delimitation of the contact region, the latter can be incorporated specifically at that point in the base where the heat exchanger exhibits unstable behavior.

In one development, the contact region is designed as an elevation of the base, said elevation elevating in the direction of that side of the base which faces away from the collecting tank. This elevation reaches as far as the first tube running parallel to the end side of the base without the cross section of the rim hole receiving the tube being reduced. Owing to said elevation, construction space is saved, and a fin which can be formed on the block for supporting said tube only by complex structural measures can be dispensed with.

In one variant, the elevation is arranged approximately centrally on the end side of the base. Said central arrangement not only makes it possible to form the support at the location where the maximum possible stress of the tube is present, but at the same time to serve as an installation aid. When the base is pressed onto the tubes, the edge ends of the tube always spread somewhat, since the introduction of force via the side parts of the tubes generally cannot take place over the entire length of the fin. When a base with the central elevation is used, the tube end of the tube extending directly parallel to one of the end sides is aligned again with the respective rim hole in the base such that a probability of damage to the tube when the heat exchanger is compressed is reduced. Said central elevations can simply be integrated into a punching tool and can be used in the finishing machine of the block.

The elevation is advantageously soldered to the rim hole receiving the tube which is directly opposite the end side. As a result, it is ensured that the tube maintains the firstly existing position for the service life of the heat exchanger.

In a further refinement, the elevation is designed as an embossed portion punched out of the base. Additional components for forming the elevation are therefore omitted. The elevation can be produced at the same time as the rim holes during the production of the base, as a result of which the production method is simplified.

In one variant, the contact region is formed by the rim hole which receives the tube opposite the end side and which is drawn as far as the channel-shaped circulating means in the base. The reinforcement of the rim hole permits the latter to be used as an insertion aid for the tube end, as a result of which the tube is arranged parallel to the rim hole and damage during the pressing of the base onto the block consisting of tubes and fins is prevented.

In another embodiment, a folded tube is used. Although this tube is highly unstable during processing, the elevation or raised portion of the contact region ensures that the folded tube maintains its shape when pressed into the base.

Further advantageous refinements are described by the description below of the figures and by the dependent claims.

BRIEF DESCRIPTION OF THE DRAWINGS

The invention is explained in more detail below on the basis of at least one exemplary embodiment and with reference to the drawings, in which.

PREFERRED EMBODIMENT OF THE INVENTION

Identical features are indicated by the same reference numbers.

Figure 1:
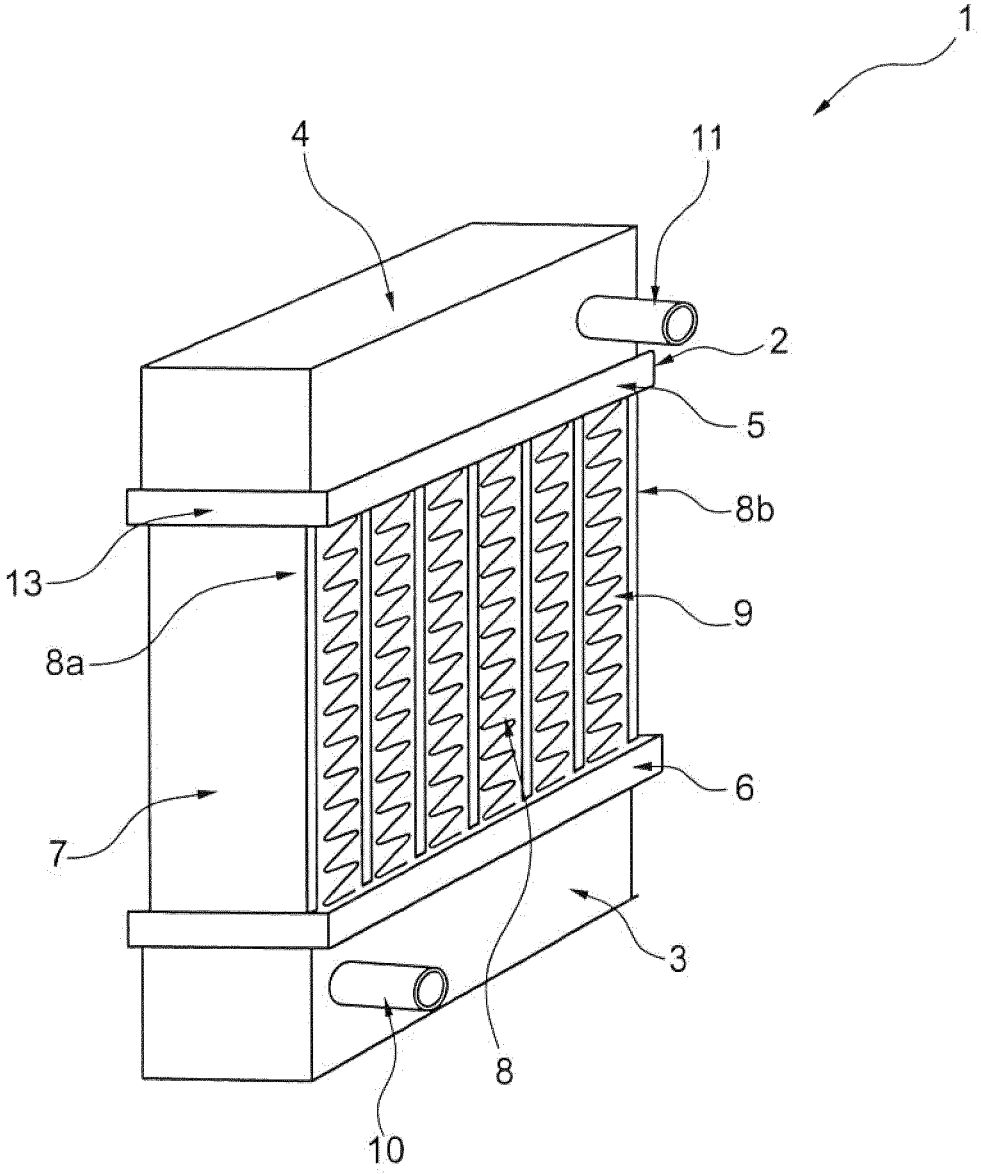
FIG. 1 shows an illustration of a heat exchanger.

FIG. 1 illustrates a heat exchanger 1, in particular a coolant cooler, which consists of a block 2 which is arranged between two collecting tanks 3, 4, wherein the first collecting tank 3 can serve for the entry of a medium to be cooled into the heat exchanger 1, whereas the cooled medium can leave the heat exchanger 1 through the second collecting tank 4. However, in another variant, the first collecting tank can also comprise an inlet and an outlet, whereas the second collecting tank then merely brings about a deflection without discharge.

Each collecting tank 3, 4 here has a base 5, 6 to which the block 2, which is closed off by a side part 7, is connected. The block 2 consists of a plurality of tubes 8 and a plurality of fins 9, wherein tube 8 and fin 9 are preferably arranged in an alternating manner with respect to one another. The collecting tank 3 here has a connecting branch 10 into which the coolant which is conducted out of the internal combustion engine (not illustrated specifically) and is heated up by the latter flows, the coolant being conducted through the tubes 8 of the block 2 to the second collecting container 4. A gaseous medium, preferably air, is conducted through the block 2, in particular the fins 9, said medium absorbing the heat of the cooling medium flowing through the tubes 8 and removing the heat from the heat exchanger 1. The cooling medium is thereby cooled. The second collecting tank 4 of the heat exchanger 1, in which collecting tank the cooled cooling medium flows, comprises a further connecting branch 11 through which the cooling medium is discharged from the heat exchanger 1 and is supplied again to the internal combustion engine.

The tubes 8 have a cross section similar to a rectangle. They are preferably folded. As is apparent from FIG. 2, in which the base 5 of the collecting tank 3 is partially illustrated, the base 5, which is likewise designed in a manner similar to a rectangle, has a plurality of rim holes 12. The rim hole 12 is an opening which is likewise of rectangular design and into which the end of one tube 8 in each case is pushed. In the case of the first tube 8*a* and the last tube 8*b* of the block 2, which tubes both run directly parallel to an end side 13 of the base 5, there is the problem that the fins 9 do not reach as far as the base 5. As a result, the tubes 8*a*, 8*b* running parallel to the end sides of the base are unstable, and this can result in tube breakage.

Figure 2:
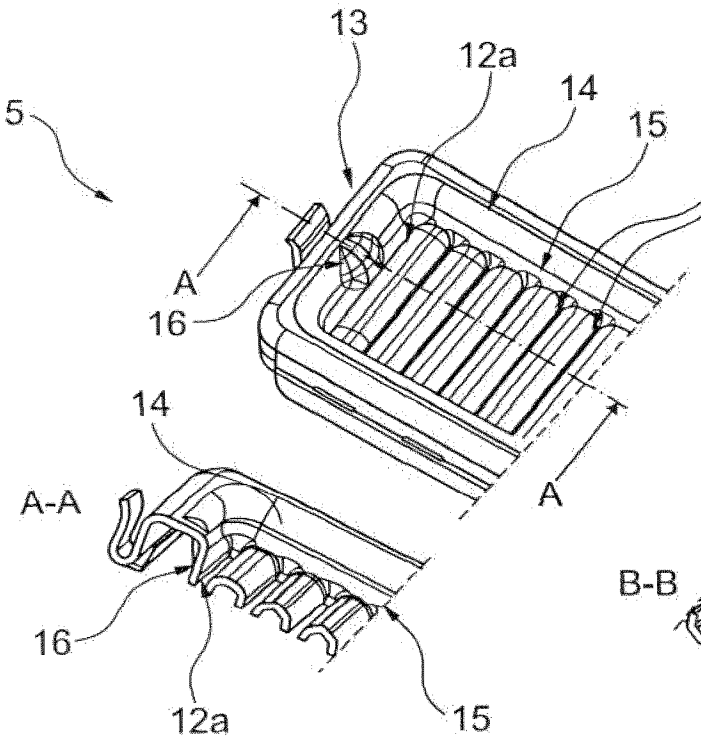
FIG. 2 shows a model view of a base of a heat exchanger in a view from above.

The base 5 has a channel-shaped circulating means 14, into which the collecting tank 3 is inserted with the interposition of a seal. Said circulating means 14 is illustrated in FIG. 2 in the form of a hollow part facing outward. The circulating means 14 is separated from the tubes 8*a* and 8*b* by an expanded region 15. Starting from said channel-shaped circulating means 14, an elevation 16 extends as far as the rim hole 12*a* which receives the first tube 8*a* directly opposite the end side 13. Said elevation 16 firstly has the effect that the position of the tube 8*a*, which extends in the first rim hole 12*a*, is stabilized. Furthermore, the elevation 16 serves, when the tubes 8 are clamped to the base 5, to guide the folded tube 8*a*, which slightly spreads under the pressure of the block 2, into the rim hole 12*a*, as a result of which the end of the tube 8*a* is again parallel to the rim hole 12*a* and simple processing is possible.

Figure 3:
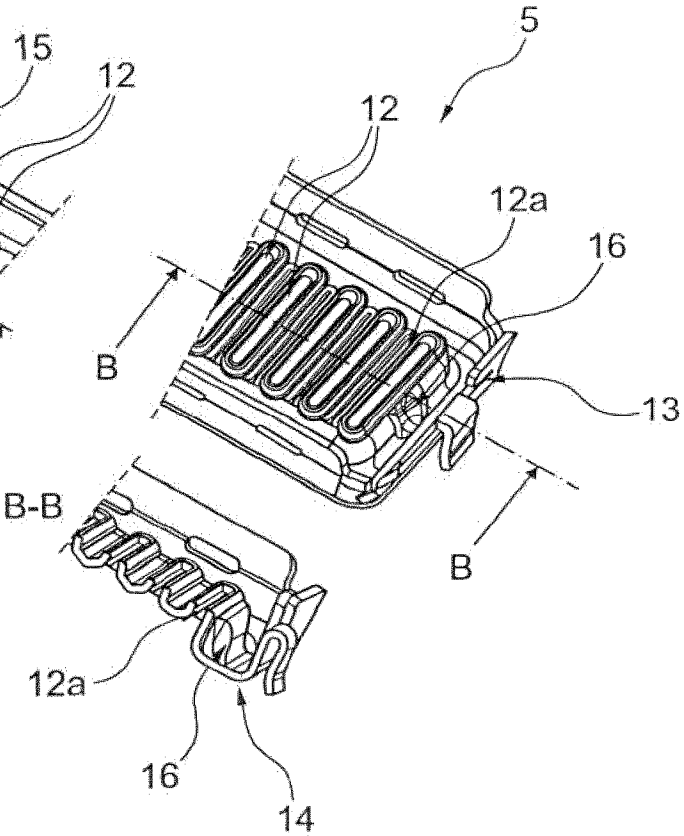
FIG. 3 shows a model view of the base of the heat exchanger in a view from below.

FIG. 3 illustrates the base 5 in a view from below, in which it is clear that the rim holes 12 have a collar-like design so that they can better surround the tubes 8. From this view, in particular the section B-B, it is clear that the elevation 16 is stamped out of the base 5. The base 5 is produced together with the rim holes 12 from sheet metal in a punching process.

Figure 4:
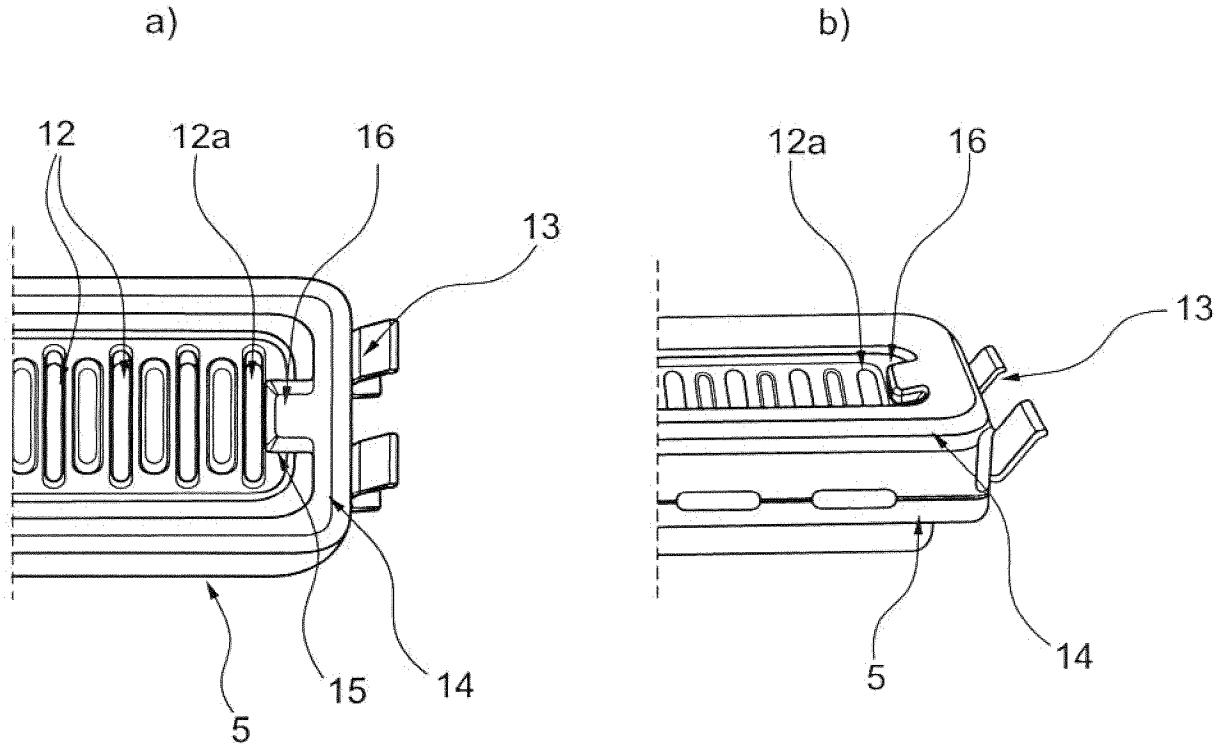
FIG. 4 shows a cutout of a base of the heat exchanger with an elevation.

From FIG. 4, where the base 5 is once again illustrated in detail, it is apparent that the elevation 16, which elevates on the side of the base 5 which is opposite the collecting tank 3, extends as far as the first rim hole 12*a* of the first tube 8*a*. It is clear in particular from FIG. 4*b* that the elevation 16 extends at a higher level than the formation of the rim hole 12*a*. It is advantageous here that the elevation 16, however, does not reduce the cross section of the rim hole 12*a*, but rather keeps the latter constant, and therefore a tube of customary size can be inserted there. With the aid of this elevation 16, the end of the tube 8*a* is guided into the rim hole 12*a* during installation. As a result, the tube end of the tube 8*a* is aligned again with the rim hole 12*a*, and therefore a probability of damage is reduced.

The explanations provided in conjunction with the collecting tank 3 and the base 5 also apply analogously to the collecting tank 4 and the base 6 thereof.

The elevation 16 can be integrated in a simple manner into a punching tool. An alternating use of embodiments of the base 5, 6 with and without an elevation is possible without each finishing machine of a block having to be adapted. A finishing machine of a block constitutes a tool in which the heat exchanger 1 is manufactured as a whole. The manufacturing sequences are therefore not changed for the production of a block.

Figure 5:
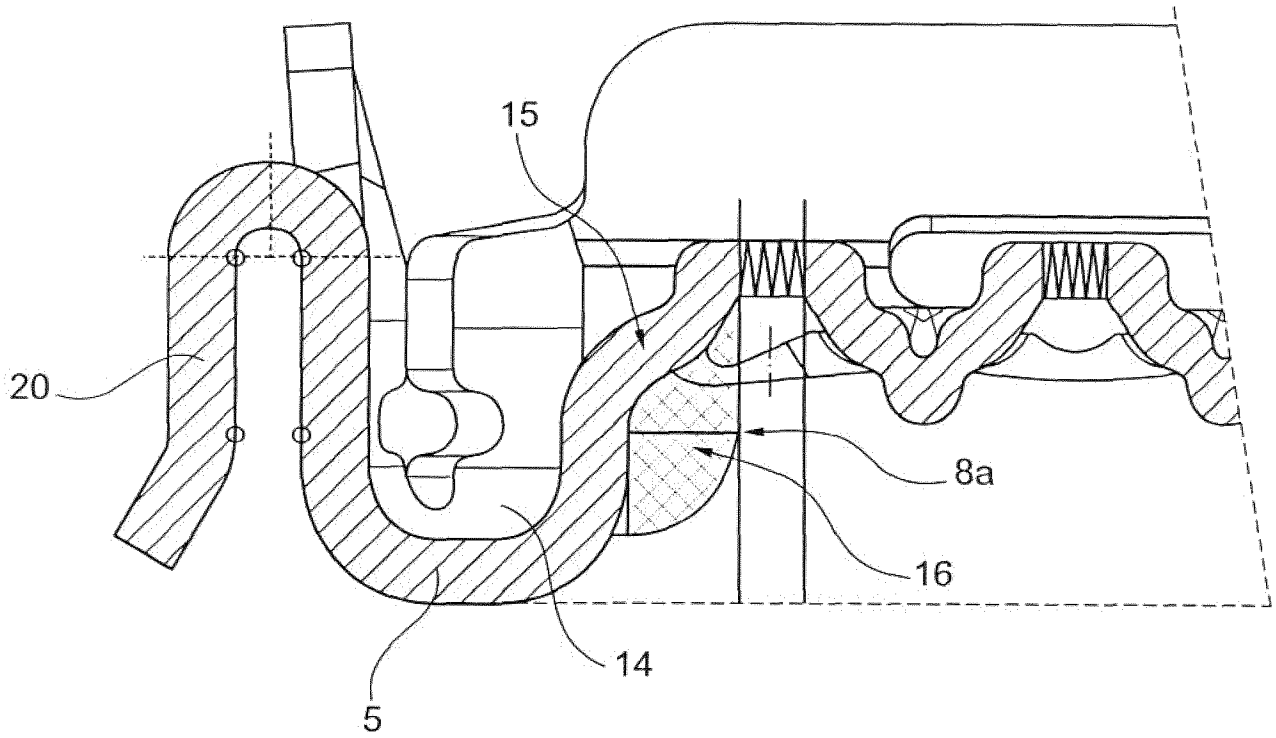
FIG. 5 shows a section through a base of a heat exchanger.

FIG. 5 shows an end region of the base 5 according to the invention, in which a channel-shaped groove is formed in an encircling manner as a circulating means 14, in which the collecting tank (not illustrated) can be inserted by the collecting tank foot thereof with the interposition of a seal (not illustrated). Said circulating means 14 is formed as a U-shaped hollow part facing outward, wherein, in the center of the narrow sides, an oppositely curved region 20 is directly connected to the U-shaped hollow part 14 and can serve as a receptacle, for example, for a side part. The circulating means 14 is separated from the tube openings or from the rim holes 12*a* by an expanded region 15. Starting from said channel-shaped circulating means 14, an elevation extends as far as the rim hole 12*a* which receives the first tube 8*a* directly opposite the end side 13.

The invention claimed is:

1. A heat exchanger, comprising a block having fins and rectangular tubes, wherein the block is arranged between a first collecting tank and a second collecting tank wherein the first and second collecting tanks are each closed off by a base, wherein each base comprises a central region extending along a length of the base, a first and second end side arranged on end regions of the base opposite one another, a plurality of rim holes sequentially arranged in the central region configured to receive the rectangular tubes of the block, a channel-shaped groove encircling the base configured to mate with an edge of the first or second collecting tank, a first and second elevation arranged centrally on the first and second end sides of the base such that each abuts a portion of the groove nearest to the first and second end side respectively, wherein the first and second elevations extend above the central region in a direction away from the collecting tank attached to the base.

2. The heat exchanger as claimed in claim 1, wherein an outside side of the first and second elevation is adjacent to the encircling groove, wherein the inside side of the first and second elevation is adjacent to a respective rim hole of the plurality of rim holes, wherein the first and second elevation extend between the encircling groove and said rim hole.

3. The heat exchanger as claimed in claim 2, wherein the first and second elevation are locally delimited such that they do not extend across the entire width of a respective adjacent rim hole.

4. The heat exchanger as claimed in claim 2, wherein the first and second elevation elevate in the direction of that side of the base which faces away from the collecting tank.

5. The heat exchanger as claimed in claim 4, wherein the first elevation and the second elevation are soldered adjacent to a respective rim hole of the plurality of rim holes which is directly opposite a respective end side.

6. The heat exchanger as claimed in claim 2, wherein the first and second elevation are formed adjacent to a respective rim hole of the plurality of rim holes which receives the rectangular tube opposite a respective end side and which is drawn as far as the groove such that the first and second elevation each abut said rectangular tube.

7. The heat exchanger as claimed in claim 1, wherein the first elevation and the second elevation are configured as an embossed portion punched out of the base.

8. The heat exchanger as claimed in claim 1, wherein the rectangular tubes are folded.

* * * * *